US005092132A

United States Patent [19]

Marshall et al.

[11] Patent Number: 5,092,132

[45] Date of Patent: Mar. 3, 1992

[54] SEPARATION OF AIR: IMPROVED HEYLANDT CYCLE

[76] Inventors: John Marshall, Hunters Lodge, London Road, Ascot, Berkshire, SL5 7EQ; Alec E. Schofield, 33 Fearon Road, Hastings, East Sussex, TN34 2DL, both of England

[21] Appl. No.: 579,112

[22] Filed: Sep. 6, 1990

[30] Foreign Application Priority Data

Sep. 22, 1989 [GB] United Kingdom ..... 8921428

[51] Int. Cl.[5] ..... F25J 3/02

[52] U.S. Cl. ..... 62/24; 62/38; 62/42

[58] Field of Search ..... 62/11, 13, 24, 36, 38, 62/42

[56] References Cited

U.S. PATENT DOCUMENTS 4,222,756 9/1980 Thorogood ..... 62/38
4,303,428 12/1981 Van der Bussche ..... 62/13
4,372,764 2/1983 Theobald ..... 62/13

*Primary Examiner*—Ronald C. Capossela
*Attorney, Agent, or Firm*—Robert I. Pearlman; David M. Rosenblum

[57] ABSTRACT

A compressed, purified air stream is reduced in temperature by heat exchange with returning streams in heat exchanger. It is passed through a Joule-Thomson valve, and a resulting stream comprising liquid and vapor is separated in a phase separator. A resulting vapor stream is introduced through inlet into the higher pressure column of a double distillation column comprising the higher pressure column and a lower pressure column. Oxygen-rich liquid is withdrawn from the bottom of the higher pressure column through an outlet and introduced into the lower pressure column through an inlet. Pure liquid oxygen and gaseous oxygen products are withdrawn from the lower pressure column through outlets. A liquid steam is withdrawn from the phase separator and introduced into the lower pressure column through an inlet at a level above that of the oxygen-rich liquid inlet, thereby making possible more efficient operation of the lower pressure column.

6 Claims, 2 Drawing Sheets

SEPARATION OF AIR: IMPROVED HEYLANDT CYCLE

TECHNICAL FIELD

The present invention relates to method and apparatus for the separation of air in a double column.

BACKGROUND OF THE PRIOR ART

The term "separation of air in a double column" as used herein is definitive of a method or apparatus in which a purified air stream at a temperature suitable for its separation by fractional distillation is introduced into a higher pressure distillation column, the top which is in heat exchange relationship with the bottom of a lower pressure distillation column; the air is separated in the higher pressure column into oxygen rich liquid and gaseous nitrogen fractions., the gaseous nitrogen fraction is condensed and used at least in part to provide reflux for the higher pressure column; a stream of the oxygen rich fraction in the liquid phase is withdrawn from the bottom of the higher pressure column and introduced into the lower pressure column at an intermediate level and is separated therein into oxygen and nitrogen fractions., and product oxygen is withdrawn from the lower pressure column. If desired, a liquid oxygen product may be produced. Typically, the top of the higher pressure column and the bottom of the lower pressure column share a condenser reboiler which serves to condense nitrogen at the top of the higher pressure column and thereby provide a reflux for the higher pressure column and reboils liquid oxygen in the bottom of the lower pressure column.

Typically, the higher pressure column operates at an average pressure in the range of 5 to 6 atmospheres absolute (500 to 600 kPa) and the lower pressure column at a pressure in the range 1 to 1.5 atmospheres absolute (110 to 150 kPa). The incoming air is compressed to a pressure in excess of the operating pressure of the higher pressure column. When, in particular, it is desired to produce a liquid oxygen product, part of the incoming air may be liquefied. In order to liquefy the air, it is compressed to a pressure well in excess of the operating pressure of the higher pressure column, typically a pressure of 10 atmospheres (1000 kPa) or more. Although modern air separation plants tend to use centrifugal or other forms of rotary compressors and expanders, older air separation plants use reciprocating compressors that generate air pressures typically greater than 100 atmospheres absolute (10000 kPa).

SUMMARY OF THE INVENTION

The present invention relates to a method and apparatus for improving the efficiency with which the lower pressure column operates when the incoming air is typically compressed to a pressure in excess of 10 atmospheres absolute (1000 kPa) and when liquid oxygen is withdrawn from the column either as a liquid product or for use in forming oxygen in the gaseous state. For example, liquid oxygen may be withdrawn from the lower pressure column as liquid and then pumped to a higher pressure, typically for cylinder filling, and after heat exchange with the incoming air discharged as gaseous product at pressure.

According to the present invention there is provided a method of separating air in a double column (as hereinbefore defined) in which liquid oxygen is withdrawn from the lower pressure column, wherein a stream of liquid air of different composition from the oxygen-rich liquid is introduced into the lower pressure column at a level above that at which the oxygen-rich liquid enters that column.

The invention also provides apparatus for separating air in a double column (as hereinbefore defined) in which the lower pressure column has an inlet for liquid air at a level above that of the inlet for the oxygen-rich liquid and an outlet for the withdrawal of liquid oxygen.

As a result of introducing the liquid air into the lower pressure column, the double column requires a substantial increase in the number of theoretical stages of separation in comparison with a similar double column in which there is no such liquid air introduction into the lower pressure column. In spite of the increased pressure drops in the double column, the result is that less energy is dissipated in the total irreversibilities of the double column. The separation in the column more closely approaches that of a thermodynamically reversible process and the resulting reduced energy loss allows a higher degree of separation to be achieved, making possible higher yields of products of a given purity.

Preferably from 2% to 30% of the incoming air is liquefied before being introduced into the double column. The precise proportion of the incoming air that is liquefied depends on the proportion of the oxygen product that is required from the lower pressure column as liquid. Preferably at least 15% by volume of the incoming air is liquefied, and if the entire oxygen product is required in the liquid state, more than 26% by volume of the incoming air is liquefied.

Preferably, the liquid air is formed by performing at least two successive Joule-Thomson expansions of precooled purified air initially at a pressure of at least 15 atmospheres absolute (1500 kPa). The first or upstream Joule-Thomson expansion preferably reduces the pressure to about that of the higher pressure column. The resulting mixture of liquid and flash gas is preferably separated in a separator and the gaseous phase (which is now depleted in oxygen) is preferably introduced into the higher pressure column at a level above that of the main air feed (which enters the bottom of that column). The liquid from the phase separator is then preferably sub-cooled before being subjected to the second Joule-Thomson expansion which reduces the pressure to about that of the operating pressure of the lower pressure column. The resulting liquid and flash vapour stream is then introduced into the lower pressure column.

The main air stream is preferably introduced into the higher pressure column at a temperature not more than 10K above its saturation temperature. In one preferred example of a method according to the invention, the main air stream is taken directly from an expansion machine.

We believe that the method and apparatus according to the invention are especially useful to increase the yield and output of air separation plants with equipment installed for liquefaction of a fraction of the air feed. The method and apparatus according to the invention may be particularly useful when the air is compressed to a pressure of at least 100 atmospheres. There are today throughout the world a large number of air separation plants that employ such large pressures. The operation of such plants may be improved by adapting them to perform the method according to the invention. A plant may be so adapted by removing its existing column and substituting for that column one having the necessary inlets, outlets and number of trays or other liquid-vapour contact means to enable the method according to the invention to be performed.

BRIEF DESCRIPTION OF THE DRAWINGS

A method and apparatus according the invention will now be described by way of example with reference to the accompanying drawings in which.

DETAILED DESCRIPTION OF THE INVENTION

Figure 1:
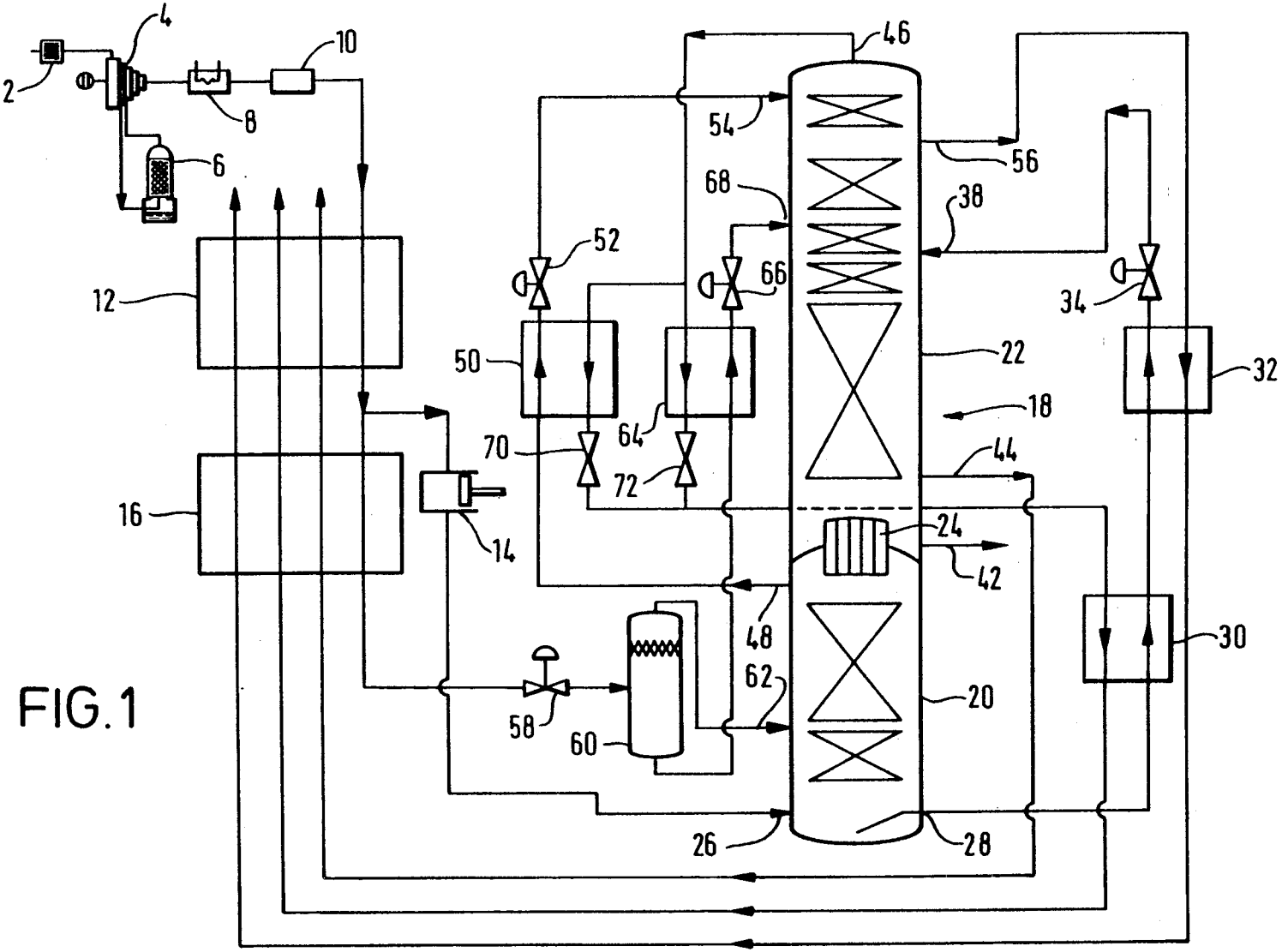
FIG. 1 is a schematic circuit diagram of an air separation plant that is able to produce liquid oxygen as a product.

Referring to FIG. 1 of the drawings, there is illustrated an air separation apparatus which is intended for operation on the Heylandt Cycle. Atmospheric air is freed from dust by filtration in a filter 2 and compressed to 150 to 200 bar (15000 to 20000 kPa) in a reciprocating compressor 4 having five or six stages. In each stage the pressure is increased by a factor of less than three, and between each stage and after the final stage, the air is cooled with water in order to remove the heat generated during compression. (Only the final water cooler 8 is shown in the drawing.) After the second stage of compression, when the air is at a pressure of about 800 kPa, carbon dioxide is removed by scrubbing with caustic soda solution in a tower 6. The resulting carbon dioxide free air is returned to the remaining stages of the compressor 4. Much of the water vapour initially present in the air is driven out by the compression and the remainder is removed downstream of the after cooler 8 by passage through an adsorber 10 which contains beds of silica gel or alumina pellets.

The thus purified air then enters a first heat exchanger 12 in which it is reduced in temperature to a temperature of about 250K. At this temperature the high pressure air stream is split into two parts. About 75% of the air flow is passed into an expansion engine or machine 14, typically of the reciprocating kind, in which it is expanded to a pressure in the range of 5.5 to 6 bar (550 to 600 kPa) and a temperature 5K above the saturation temperature at this pressure. The remainder of the air stream leaving the cold end of the heat exchanger 12 is passed through a second heat exchanger in which it is reduced in temperature by heat exchange to a temperature sufficiently low for the air to be liquefied on subsequent Joule-Thomson expansion.

The resultant streams of cooled air from respectively the expansion machine 14 and the cold end of the second heat exchanger 16 are used as sources of air for a double distillation column 18 comprising a higher pressure column 20 and a lower pressure column 22 linked by a condenser-reboiler 24. Both columns 20 and 22 contain sieve trays or other devices for affecting intimate contact and mass transfer between a descending liquid phase and an ascending vapour phase. The double column 18 is the source of the returning streams for the heat exchangers 16 and 12. The expanded air stream from the expansion machine 14 is introduced into the higher pressure column 20 through an inlet 26. The air is separated in the higher pressure column 20 into a relatively pure nitrogen fraction that collects at the top of the column and an oxygen-rich liquid fraction that collects at the bottom of the column.

The oxygen-rich liquid fraction typically contains from 30% to 40% by volume of oxygen. The nitrogen fraction at the top of the column enters the condenser-reboiler 24 and condenses therein. A part of the condensed nitrogen is employed as reflux in the higher pressure column 20.

A stream of oxygen-rich liquid is withdrawn from the bottom of the higher pressure column 20 through an outlet 28, is sub-cooled by passage through first a heat exchanger 30 and then a further heat exchanger 32. The resultant sub-cooled oxygen-rich liquid is reduced in pressure to about that of the lower pressure column by passage through a Joule-Thomson valve 34. The resulting mixture of liquid and flash gas is then introduced into the lower pressure column 22 through an inlet 38 at an intermediate level. This oxygen-rich fluid is separated into oxygen and nitrogen by fractional distillation in the lower pressure column 22. Reflux for the column 22 is provided by taking a stream of liquid nitrogen from the higher pressure column 20 through an outlet 48, sub-cooling the stream in a heat exchanger 50 and then reducing its pressure by passage through a Joule-Thomson valve 52 and introducing the thus expanded liquid into the top of the column 22 through an inlet 54. Pure liquid oxygen collects at the bottom of the column 22 and is reboiled by the condenser-reboiler 24. Liquid oxygen product is withdrawn from the column 22 through an outlet 42 and gaseous oxygen product is withdrawn from the column 22 through an outlet 44. Pure nitrogen collects at the top of the column 22 and is withdrawn as product through an outlet 46. In order to maintain the purity of the nitrogen product withdrawn through the outlet 46, a waste nitrogen stream is withdrawn from the column 22 through an outlet 56 at a level below the top of the column 22.

In accordance with the invention, the efficiency with which the double distillation column 18 operates is improved by introducing into the lower pressure column 22 a stream of liquid air having a composition different from that of the oxygen-rich liquid entering through the inlet 38. The cold air stream leaving the cold end of the heat exchanger 16 is passed through a Joule-Thomson valve 58 and the pressure of the stream is thereby reduced to approximately that at which the higher pressure column 20 operates. A mixture of liquid and gas is formed as a result and this mixture is passed continuously into a phase separator 60 in which the liquid and vapour phases are disengaged from one another. As a result of the passage through the expansion valve 58 and the subsequent phase separation in the separator 60, the liquid phase is slightly enriched in oxygen while the vapour phase becomes significantly depleted in oxygen. A stream of the vapour phase, typically containing about 10% by volume of oxygen, is introduced into the higher pressure column 20, at a level several trays above that of the inlet 26, through an inlet 62. A stream of the liquid phase is withdrawn from the phase separator 60 and is passed through a heat exchanger 64 in which it is sub-cooled. The resulting sub-cooled liquid is then passed through an expansion valve 66 to reduce its pressure to approximately that of the lower pressure column 22. The resulting expanded liquid air stream is then introduced into the lower pressure column 22 through an inlet 68 at a level several trays above that of the inlet 38. Introduction of the liquid air into the lower pressure column 22 through the inlet 68 results in less energy being dissipated in the total irreversibilities of the double column notwithstanding the pressure drops that arise from the additional number of theoretical stages of separation that are required. The double column thus more closely approaches that of a thermodynamically reversible process. The reduced energy loss allows a higher degree of separation to be achieved which makes possible higher yields of products of a given purity. Typically, oxygen may be produced at a purity of 99.5% in a yield of at least 96%. Pure nitrogen containing one volume per million (VPM) or less of oxygen may be produced in a yield of at least 75%. The purity of the nitrogen product will depend on the number of theoretical stages of separation that are employed in the double column 18. If desired, it is also possible to separate argon or other noble gases from the double column 18 by means that are conventional in the art.

The streams that are withdrawn from the lower pressure distillation column 22 are used to provide cooling for the heat exchangers 12, 16, 30, 32, 50 and 64 that are employed in the apparatus shown in the drawing. The heat exchanger 32 is cooled by passage therethrough of the waste nitrogen stream withdrawn from the column 22 through the outlet 56. After leaving the warm end of the heat exchanger 32 the waste nitrogen stream then passes through the heat exchanger 16 and 12 countercurrently to the air flow and is vented to the atmosphere.

The product nitrogen stream withdrawn from the lower pressure column 22 through its outlet 46 is employed to provide cooling for the heat exchangers 50, 64 and 30. The stream of product nitrogen is split upstream of the respective cold ends of the heat exchangers 50 and 64 and one part is passed through the heat exchanger 50 countercurrently to the liquid nitrogen stream withdrawn from the higher pressure column 20 while the remainder passes through the heat exchanger 64 countercurrently to the liquid air stream from the phase separator 60. The two parts of the product nitrogen stream are then reunited downstream of the respective warm ends of the heat exchangers 50 and 64. If desired, balancing valves 70 and 72 may be employed to adjust the relative flows of product nitrogen through the heat exchangers 50 and 64. The reunited product nitrogen stream then flows through the heat exchanger 30 countercurrently to the oxygen-rich liquid stream withdrawn from the higher pressure column 20 through the outlet 28. After leaving the cold end of the heat exchanger 30 the product nitrogen stream then flows through the heat exchanger 16 and 12 in sequence countercurrently to the incoming air stream. The nitrogen stream may then be compressed and used to fill cylinders.

The gaseous oxygen stream withdrawn from the lower pressure column 22 through the outlet 44 also passes through the heat exchangers 16 and 12 countercurrently to the incoming air stream and may if desired be compressed and used to fill cylinders.

The relative rates of production of gaseous and liquid oxygen product by the double column 18 will depend on the proportion of the purified air that is liquefied. In one example of the operation of the apparatus shown in the drawing, 23.1% of the purified air is introduced into the lower pressure column 22 through the inlet 68. About 95% of this air is in the liquid phase and the rest in the vapour phase. The remainder of the air is introduced as vapour into the higher pressure column. About 2% of the total air flow enters the column 20 through the inlet 62 while the rest enters through the inlet 26. In this example, the composition of the air entering the lower pressure column 22 through the inlet 68 is 77 mole percent of nitrogen, 1 mole percent argon and 22 mole percent oxygen. The composition of the vapour entering the column 20 through the inlet 62 is 89 mole percent nitrogen, 1 mole percent argon and 10 mole percent oxygen. In this example in the operating pressure at the top of the column 22 is 1.36 atmospheres absolute.

Various changes and modifications may be made to the method and apparatus according to the invention. The invention is not restricted to the use of reciprocating machinery to compress and expand the air. Nor is it necessary to expand the air in an expansion machine to generate the necessary refrigeration for the process. If desired a nitrogen stream may be so expanded. Moreover, various alternative means well known in the art may be used to purify the incoming air.

Figure 2:
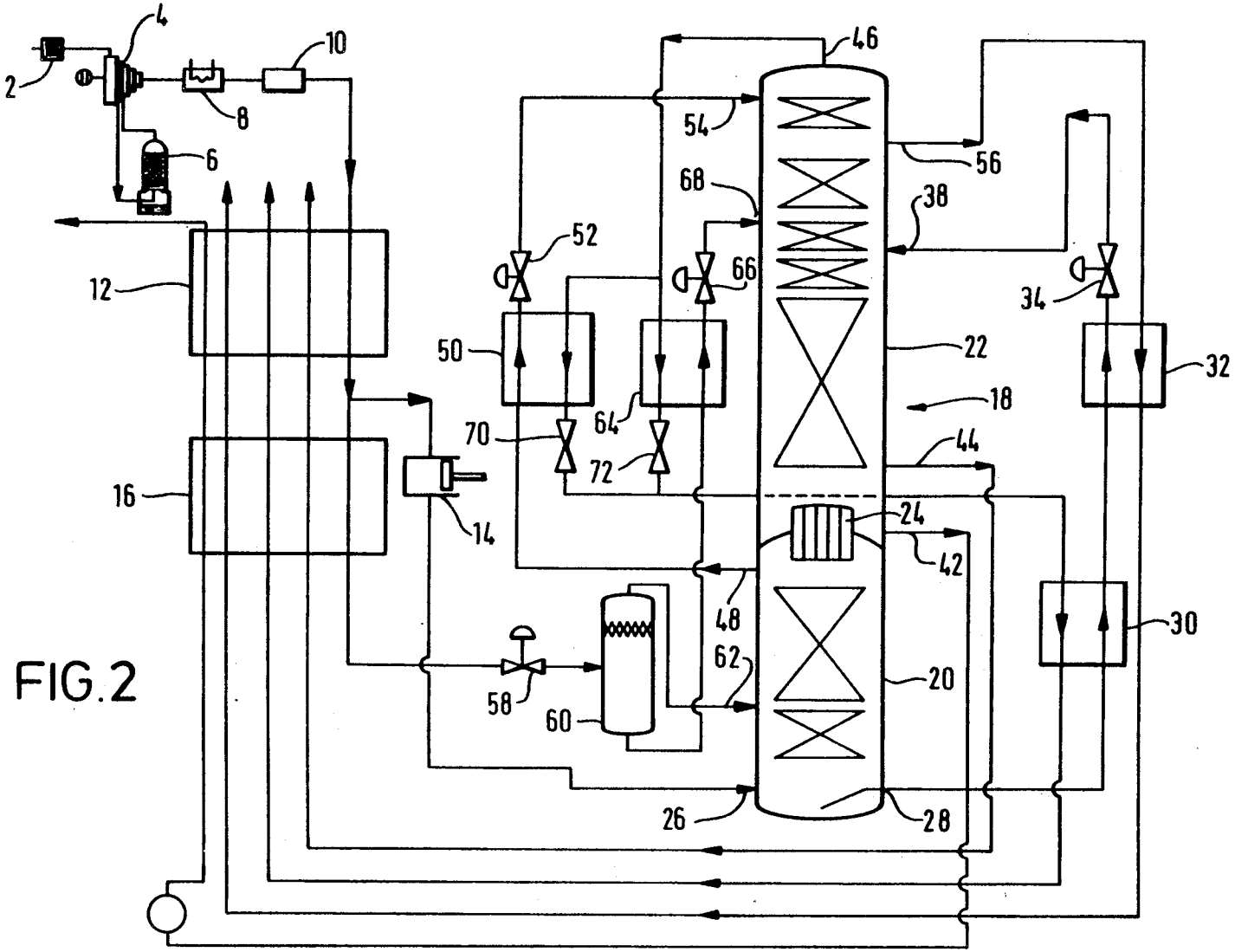
FIG. 2 is a schematic circuit diagram of an air separation plant that is able to produce liquid oxygen and then the liquid to form a high pressure gaseous oxygen product.

An example of a plant that produces a high pressure oxygen product in accordance with the invention is shown in FIG. 2 of the drawings. The plant shown in FIG. 2 is very similar to that shown in FIG. 1 and like parts in the two Figures are identified by the same reference numerals. Similarly the operation of the plant shown in FIG. 2 is substantially the same as that shown in FIG. 1 save in one respect. This difference is that referring to FIG. 2, the liquid oxygen withdrawn from the column 22 through the outlet 42 is pumped by a pump 74 through the heat exchangers 16 and 12 in sequence countercurrently to the incoming air stream. As a result a high pressure gaseous oxygen product stream leaves the warm end of the heat exchanger 12 and may for example be used to fill cylinders.

We claim:

1. A method of separating air, comprising: compressing and purifying the air; forming a first stream composed of the compressed and purified at a temperature suitable for its separation by fractional distillation; introducing the first stream into a higher pressure distillation column, the top of which is in heat exchange relationship with the bottom of a lower pressure distillation column; separating the air in the higher pressure column into oxygen-rich liquid and gaseous nitrogen fractions; condensing the gaseous nitrogen fraction and using it, at least in part, to provide reflux for the higher pressure column; withdrawing a stream of the oxygen-rich liquid fraction from the bottom of the higher pressure column and introducing it into the lower pressure column at an intermediate level thereof; separating the oxygen-rich liquid fraction into oxygen and nitrogen fractions within the lower pressure column; withdrawing product oxygen and liquid oxygen from the lower pressure column; forming a second stream composed of the compressed and purified air; pre-cooling the second stream and subjecting the pre-cooled second stream to a first Joule-Thomson expansion to form a liquid-vapor mixture at a pressure of essentially that of the higher pressure column; separating the liquid-vapor mixture into a liquid phase and a vapor phase; introducing a stream of the vapor phase into the higher-pressure column at a level above that at which the first stream enters the higher pressure column; and taking the entire liquid phase and forming it into a stream; sub-cooling the stream composed of the liquid phase and subjecting it to a second Joule-Thomson expansion and then introducing it into the lower pressure column.

2. The method as claimed in claim 1, in which from 2 to 30% by volume of the purified air is introduced into the lower pressure column as liquid.

3. The method as claimed in claim 1, in which from 15 to 30% by volume of the purified air is introduced into the lower pressure column as liquid.

4. The method as claimed in claim 3, in which the air is compressed to a pressure of at least 10 atmospheres absolute.

5. The method as claimed in claim 1, in which the said first stream is expanded in an expansion machine before being introduced into the higher pressure column.

6. An apparatus for separating air, comprising:

(a) means for compressing air;

(b) means for purifying the compressed air;

(c) means for forming a first stream of the compressed and purified air at a temperature suitable for its separation by fractional distillation;

(d) a higher pressure distillation column for separating air into oxygen-enriched liquid and gaseous nitrogen fraction;

(e) the high pressure distillation column having an inlet for said first stream of compressed and purified air;

(f) a lower pressure distillation column for separating the oxygen-enriched liquid, the bottom of which is in heat exchange relationship with the top of the higher pressure distillation column;

(g) a condenser for condensing the said gaseous nitrogen fraction and for providing a first part of the condensed nitrogen as reflux for the higher pressure distillation column;

(h) means for conducting a second part of the condensed nitrogen the lower pressure distillation column as reflux;

(i) means for conducting a stream of the oxygen-rich liquid fraction from the bottom of the higher pressure distillation column and introducing it into the lower pressure distillation column at an intermediate level thereof;

(j) the lower pressure distillation column having a first outlet for product gaseous oxygen and a second outlet for liquid oxygen;

(k) means for forming a second stream of the compressed and purified air;

(l) means for pre-cooling the second stream of the compressed and purified air;

(m) a first Joule-Thomson expansion valve for reducing the pressure of the pre-cooled stream and thereby to form a liquid-vapour mixture at a pressure essentially the same as that of the operating pressure of the higher pressure column;

(n) a phase separator for separating the liquid-vapour mixture into a liquid phase and a vapour phase;

(o) means for introducing a stream of the vapour phase into the higher pressure distillation column at a level above that of the inlet for the said first stream of compressed and purified air to the higher pressure distillation column;

(p) means for taking the entire said liquid phase as a stream and sub-cooling it;

(q) a second Joule-Thomson expansion valve for reducing the pressure of said sub-cooled stream of liquid phase; and (r) means for introducing the reduced pressured stream of the sub-cooled liquid phase into the lower pressure distillation column.

* * * * *

UNITED STATES PATENT AND TRADEMARK OFFICE

CERTIFICATE OF CORRECTION

PATENT NO. :5,092,132

DATED :March 3, 1992

INVENTOR(S) :J. Marshall et al

It is certified that error appears in the above-indentified patent and that said Letters Patent is hereby corrected as shown below:

Col. 6, line 39, after "purified" the word --air-- should be inserted.

Signed and Sealed this

Seventh Day of December, 1993

Bruce Lehman

*Attest:*

BRUCE LEHMAN

*Attesting Officer*

*Commissioner of Patents and Trademarks*